United States Patent [19]

Farrelly

[11] Patent Number: 4,544,302

[45] Date of Patent: Oct. 1, 1985

[54] CATCH BASIN GRATE RISER

[75] Inventor: Robert E. Farrelly, Windsor, Conn.

[73] Assignee: The Jack Farrelly Company, Bloomfield, Conn.

[21] Appl. No.: 607,614

[22] Filed: May 7, 1984

[51] Int. Cl.[4] ..... E01F 5/00

[52] U.S. Cl. ..... 404/2; 404/26; 52/20; 210/164

[58] Field of Search ..... 404/2, 4, 25, 26; 210/163, 164; 52/20, 19, 21; 137/364, 371

[56] References Cited

U.S. PATENT DOCUMENTS

| | | | |
|---|---|---|---|
| 797,585 | 8/1905 | Kees | 210/164 X |
| 2,993,600 | 7/1961 | Ressler | 210/164 |
| 3,945,746 | 3/1976 | Bredbenner | 210/163 X |
| 3,968,600 | 7/1976 | Bowman | 404/26 X |
| 4,281,944 | 8/1981 | Bowman | 404/26 |
| 4,302,126 | 11/1981 | Fier | 404/26 |

FOREIGN PATENT DOCUMENTS

| | | | |
|---|---|---|---|
| 2848301 | 12/1979 | Fed. Rep. of Germany | 210/164 |

*Primary Examiner*—Stephen J. Novosad
*Assistant Examiner*—Beverly E. Hjorth
*Attorney, Agent, or Firm*—McCormick, Paulding & Huber

[57] ABSTRACT

A grate riser for use with catch basins and the like comprising vertically open rectangular frames with at least two opposing frame sections carrying inwardly projecting horizontal grate support flanges and cooperating grates with opposite end portions of parallel spaced apart elongated horizontal grate elements adapted to rest on the flanges. The grate riser has a vertically open generally rectangular frame coextensive with a catch basin frame with opposing vertical side and end wall sections of a height substantially equal to the depth of new road pavement. The frame rests atop a catch basin frame with its top edge substantially level with the top surface of new pavement. At least two horizontally spaced upper riser elements depend from each of two opposing grate riser frame sections to support a pair of elevated horizontal grate support flanges. The grate support flanges have lower riser elements depending therefrom in the form of flanges which rest on the grate support flanges of the catch basin. The grate is disposed within the grate riser frame and rests on the elevated support flanges with its top surface substantially level with the top surface of the grate riser frame and new road pavement.

8 Claims, 6 Drawing Figures

CATCH BASIN GRATE RISER

BACKGROUND OF THE INVENTION

Conventional catch basins include vertically open generally rectangular frames with at least two opposing frame sections which carry inwardly projecting horizontal grate support flanges. Cooperating grates include a plurality of parallel spaced apart elongated grate elements adapted to rest at opposite end portions on the frame flanges and to be held in position in the frame by gravity. When repaving of an associated road surface is to be accomplished, there are three conventional techniques which are employed in raising the catch basins to the level of the new paving. First, the aforementioned parts of the catch basin are removed together with a precast concrete supporting member usually associated therewith. Riser elements such as bricks may then be used to support the precast concrete at the desired elevated position and the concrete unit, the catch basin frame and the grate are then repositioned atop the bricks.

Another technique or method involves the welding of sections of angle iron or the like to the bottom end portions of the grate. This results in the grate being raised to the desired level but the frame is left in its original position. At end portions of the grate the paving material finds its way between grate elements and this is of course detrimental.

A third method involves the welding of a new frame to the top of the existing frame of the catch basin. This allows only for the raising of the catch basin elements an increment equal to the height of the original frame and grate. That is, if a conventional $3\frac{1}{2}$ inch frame and grate are employed, then the elevation thereof can only be $3\frac{1}{2}$ inches when the paving may, for example, be at a desired thickness of $1\frac{1}{2}$ inches.

With each of the foregoing techniques, an inefficient and time consuming operation is involved. The removal and replacement of all or part of a catch basin requires an expenditure in time, a likely delay in the paving operation, as well as the use of heavy equipment. At a minimum, in the practice of each of the methods, welding or bricklaying operations are involved and may require considerable time and the possible transfer and return turn of parts to a welding shop for an efficient welding operation.

It is the general object of the present invention to provide a grate riser for use with catch basins and the like and which may be installed in a highly efficient and rapid operation without interfering or in any way inhibiting an associated road paving operation, and which is yet readily adapted to the elevation of a grate to any desired increment of height as may be required by the thickness of the new pavement.

SUMMARY OF THE INVENTION

In accordance with the present invention and in fulfillment of the foregoing object, a grate riser is provided for use with catch basins and the like comprising vertically open generally rectangular frames with at least two opposing frame sections carrying inwardly projecting horizontal grate support flanges. Cooperating grates have opposite end portions of parallel spaced apart elongated horizontal grate elements adapted to rest on the frame flanges so that the grate may be held within the frame by the forces of gravity.

The grate riser of the invention is a discrete member which may be disposed in a catch basin frame on removal of the grate from the frame which serves to elevate the grate a desired increment so that its top surface is in coplanar relationship with the top surface of new road pavement. The riser comprises a vertically open generally rectangular frame coextensive with an associated catch basin frame and with opposing vertical side and end wall sections of a height substantially equal to the depth of new road pavement which is to be accommodated. At least two horizontally spaced apart upper riser elements are secured to and depend from each of two opposing grate riser frame sections, preferably opposing end sections, and the sections are so chosen as to correspond to the frame sections of the catch basin which carry the supporting flanges for the grate, normally the end sections of the catch basin frame. The vertical dimension of the riser elements is such that the combined vertical dimension of the elements and the grate riser frame substantially equals the height of the catch basin grate to be accommodated thereby. The grate riser also includes a pair of elevated horizontal grate support flanges associated respectively with said two opposite grate riser frame sections and connected with the riser elements at lower end portions of the latter. At least one lower riser element is provided in association with each of the grate riser support flanges and depends from its associated support flange so as to be supported atop the grate support flanges on the catch basin frame. With the lower riser elements so supported and with the vertical dimension thereof substantially equal to the height of the grate riser frame, the frame is disposed as desired atop the catch basin frame and in close proximity thereto. The upper riser elements are in turn disposed so as to reside between the end portions of the elongated horizontal grate elements and so as not to interfere with the positioning and the desired height of the top surface of the grate riser frame and a grate disposed therein.

Preferably, the upper riser elements are attached to and depend from inner surfaces of the opposing grate riser frame sections so as to at least substantially engage inner surfaces of the flange carrying sections of the catch basin frame whereby to maintain the grate riser frame in at least one direction in a fixed position horizontally atop the catch basin frame. Further, the elevated support flanges of the grate riser preferably have outer side surfaces substantially in coplanar relationship with inner surfaces of the corresponding frame sections whereby to at least substantially engage inner surfaces of said flange carrying sections of the catch basin frame and thereby to maintain the grate riser frame in fixed position horizontally atop the said frame. Still further, opposite end surfaces of the elevated grate riser flanges and/or the riser flanges which depend therefrom are preferably arranged substantially in coplanar relationship with inner surfaces of the side sections of the catch basin frame so as to maintain the grate riser frame in fixed position horizontally in a second direction of possible accidental or incidental movement.

DESCRIPTION OF THE PREFERRED EMBODIMENT

Figure 1:
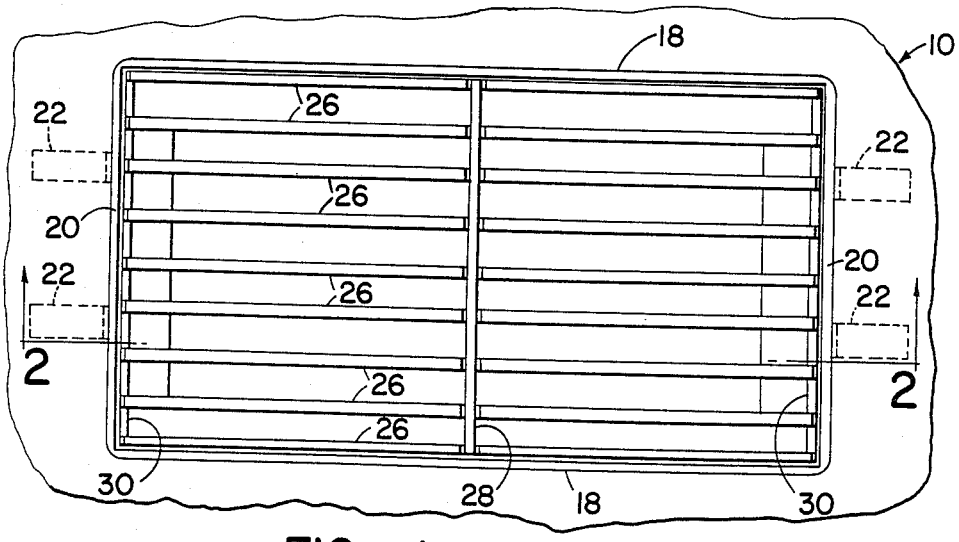
FIG. 1 of the drawings is a top view of a catch basin including a generally rectangular vertically open frame and a cooperating grate having a plurality of parallel spaced apart elongated horizontal grate elements, the grate being disposed within the frame.
Figure 2:
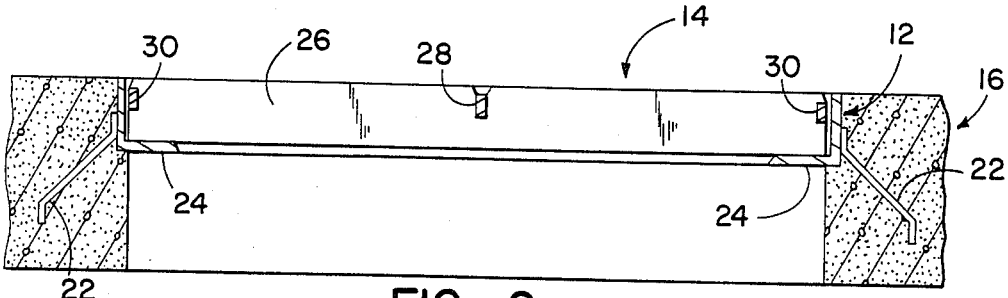
FIG. 2 is a vertical section taken generally as indicated at 2—2 in FIG. 1 and illustrating the frame and grate elements in cross section.

Referring particularly to FIGS. 1 and 2, a catch basin indicated generally at 10 comprises a frame indicated generally at 12, a grate indicated generally at 14 and a precast concrete unit indicated generally at 16 and supporting the frame and grate. The frame 12 is open vertically and takes a generally rectangular configuration with similar opposing side walls or wall sections 18,18 and similar opposing end walls or wall sections 20,20, the walls each comprising narrow vertical members and all of the walls being formed integrally. The opposing end walls 20,20 each preferably carry a pair of anchors or anchor means 22,22 which extend downwardly and outwardly relative thereto and which are embedded in the precast concrete unit 16 associated with the frame. Further, each of the end walls or frame sections 20,20 carries an inwardly projecting horizontal flange 24. As shown, the flanges 24,24 extend throughout the length of the end walls 20,20 and are formed integrally with and at right angles relative to the walls. The flanges 24,24 serve to support the grate 14 as is more fully described hereinbelow.

Catch basin grates may vary widely in construction and arrangement and the grate 14 should therefore be regarded as illustrative only. The grate 14 comprises a plurality of parallel elongated horizontal elements spaced transversely for the downward passage of water and debris of predetermined dimension. Nine (9) elongated elements 26,26 are shown but the number of such elements may of course vary widely. The elements 26,26 are elongated bar like members which are narrow vertically and which are secured in spaced position by a transversely extending intermediate member 28 and, optionally, by opposite transversely extending end members 30,30. The grate comprising the elements 26,26 and the transverse members 28,30 may be removed from and deposited within the frame 12 as an integral subassembly and it will be apparent that opposite end portions of the elements 26,26 rest on and are supported by the flanges 24,24 when the grate is positioned within the frame. The grate may be secured in position by the forces of gravity and may be readily removed and elevated by the grate riser of the invention as will be described hereinbelow.

Figure 3:
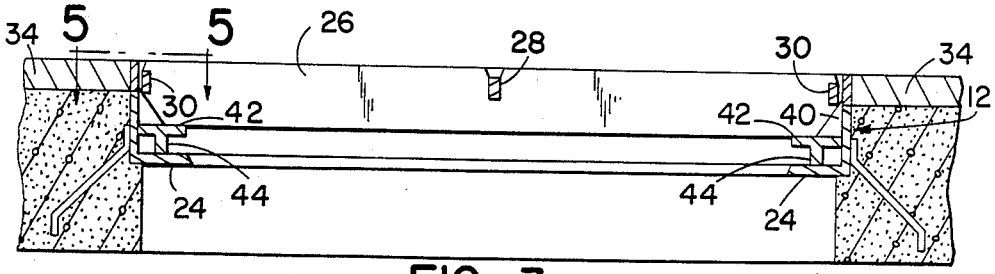
FIG. 3 is a vertical section similar to FIG. 2 but showing the FIGS. 1 and 2 elements in combination with a grate riser constructed in accordance with the present invention.
Figure 4:
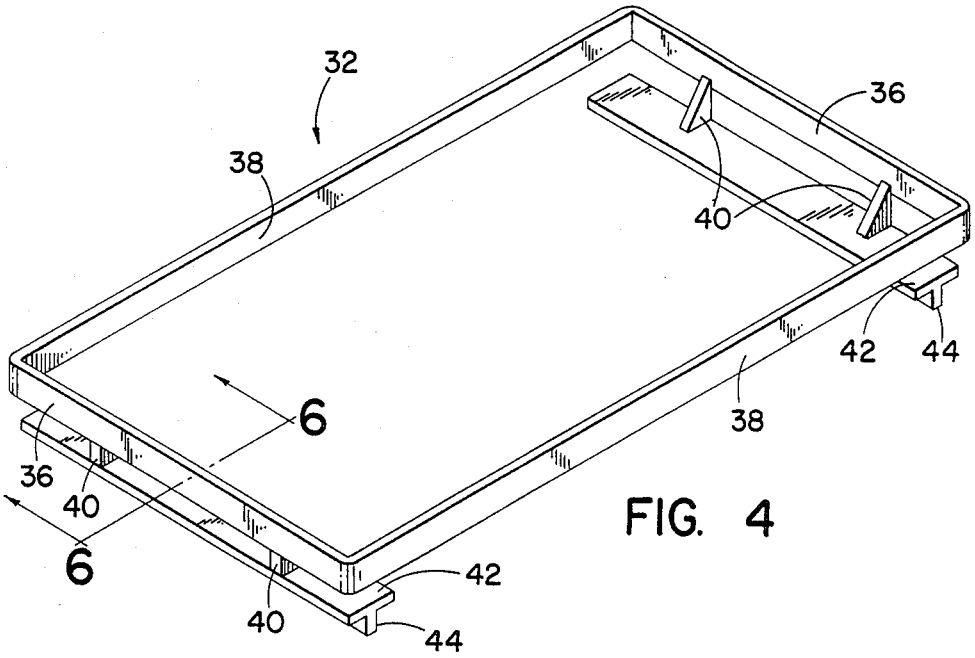
FIG. 4 is a perspective view of a grate riser constructed in accordance with the present invention.

The grate riser of the present invention is illustrated in FIGS. 3 and 4 and comprises a vertically open generally rectangular frame indicated generally at 32 and which is coextensive with a catch basin frame with which the grate riser is intended for use. The frame 32 has opposing narrow vertical end and side wall sections 36,38 of a height substantially equal to the desired depth of new road pavement as best illustrated in FIG. 3 at 34. Opposing end walls 36,36 in FIG. 4 are formed integrally with opposing side walls 38,38 and the top edge surfaces of the resulting wall 36,38 reside in the plane of the top surface of the new pavement 34 as illustrated in FIG. 3.

Figure 6:
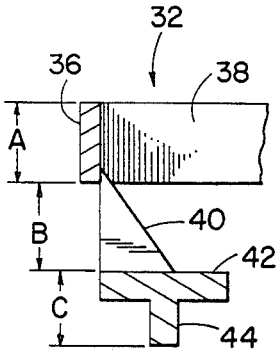
FIG. 6 is an enlarged fragmentary view taken generally as indicated at 6—6 in FIG. 4 and better illustrating the detailed construction and dimensioning of the grate riser of the present invention.

At least two horizontally spaced apart upper riser elements are secured to and depend from each of the two opposing end wall sections 36,36 of the grate riser frame. Two (2) such elements are shown as small triangular members 40,40 welded to each of the end wall sections 36,36. The upper riser elements 40,40 depend from the end walls 36,36 as best illustrated in FIG. 6 and have their outer surfaces substantially in the plane of the inner surface of the end walls 36,36. This provides for engagement or at least substantial engagement of the outer surfaces of the riser elements 40,40 with the inner surfaces of the end walls 20,20 of the catch basin frame 12 and for horizontal positioning of the grate riser in one direction relative to the frame 12. That is, the grate riser frame is thus positioned in at least in one direction, longitudinally as shown, relative to the frame 12.

The upper riser elements 40,40 respectively support a first and second auxiliary or elevated horizontal grate support flanges 42,42. The flanges 42,42 have horizontal upper surfaces extending inwardly from the end walls 36,36 as best illustrated in FIGS. 3 and 6 for the support of end portions of the grate elements 26,26 in a manner substantially identical with the support of said end portions of the elements by the flanges 24,24. Further, it should be noted that the vertical dimension of the upper riser elements 40,40, indicated at "B" in FIG. 6, is such that the height "A" of the frame 36 may be combined therewith to provide a composite height dimension "A"+"B" equal to the height of the grate 14. Thus, the grate rests on the flanges 42,42 with its upper surface substantially in coplanar relationship with the top surface of the frame 32.

Preferably, at least one lower riser element is also provided in association with each end wall of the grate riser and as shown, each of the flanges 42,42 has a lower riser flange 44,44 associated therewith and formed integrally at a lower surface thereof. That is, the flanges 42,44 together take a "T" configuration viewed in cross section and the depending flanges 44 are adapted to rest on the flanges 24,24 as best illustrated in FIG. 3. The dimension "C" in FIG. 6 measured from the top of the flange 42 to the bottom of the flange 44 is equal to the dimension "A" or the height of the walls 36,38 of the grate riser frame 32. As shown, the dimensions "A" and "C" each equal approximately 1½ inches and the cumulative dimensions "A"+"B" equal approximately three inches. In the event of pavement 34 which requires a riser in excess of the dimension "A", that is, in excess of 1½ inches, it is of course possible to design the frame 32 with a height dimension at the walls 36,38 as required for any desired depth of new pavement. The dimension "C" may of course also be similarly varied to provide for the proper elevation from the flanges 24,24 and for the coplanar relationship of the top of the grate with the top of the walls 36,38 and the new pavement.

Figure 5:
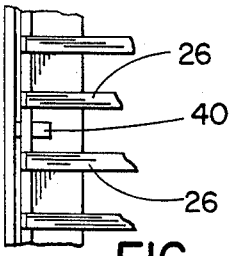
FIG. 5 is a fragmentary top view showing a portion of the FIG. 3 assembly and taken generally as illustrated at 5—5 in FIG. 3.

In FIG. 5 it will be observed that a member 40 shown is illustrated between the elements 26,26 so as not to interfere with the same and to allow a nesting relationship of the riser element 40 and the grate elements 26,26. This accommodates a high degree of flexibility in the design of the grate riser of the present invention in meeting the requirements of new pavement. That is, if the desired depth of new pavement varies, the grate riser of the present invention may be readily designed to provide for the desired coplanar relationship of the top surface of the grate riser and the elevated grate therewithin.

It will also be apparent from the foregoing that the installation of the grate riser of the present invention may be accomplished in a rapid and efficient manner. It is only necessary to lift the grate 14 from its FIGS. 1 and 2 position, position a grate riser such as 32 with its flanges 42,44 in the position shown in FIG. 3 with the flanges 44,44 resting on the flanges 24,24 and with the frame of the grate riser resting atop the frame 12 of the catch basin. Thereafter, the grate 14 may be replaced or repositioned as shown in FIG. 3 and the paving operation will then result in the FIG. 3 condition with the new pavement 34 residing in coplanar relationship with the riser frame and the grate. The time consuming and tedious tasks formerly associated with raising the grates of catch basins are thus eliminated and a rapid and efficient operation is provided in advance of the paving operation.

I claim:

1. A grate riser for use with catch basins and the like during road repaving operations, the catch basins comprising vertically open generally rectangular frames with at least two opposing frame sections carrying inwardly projecting horizontal grate support flanges and cooperating grates with opposite end portions of parallel spaced apart elongated horizontal grate elements adapted to rest on said flanges; and the grate riser comprising a vertically open generally rectangular frame coextensive with a catch basin frame and with opposing vertical side and end wall sections of a height substantially equal to the depth of new road pavement, said frame being adapted to rest atop the catch basin frame with its top edge substantially in the plane of the top surface of the new pavement, at least two horizontally spaced apart upper riser elements secured to and depending from each of two opposing grate riser frame sections, which sections correspond to said flange carrying catch basin frame sections, the vertical dimension of said riser elements being such that the combined vertical dimension of the elements and the grate riser frame substantially equals the height of the grate, a pair of elevated horizontal grate support flanges associated respectively with said two opposite grate riser frame sections and connected with said riser elements at lower end portions of the latter, and at least one lower riser element connected with each of said grate riser support flanges and depending therefrom, the vertical dimension of said lower riser elements being substantially equal to the height of the grate riser frame and said elements serving to support the grate riser and a grate thereon when they are supported atop the grate support flanges on the catch basin frame, and said upper riser elements being so spaced as to reside between end portions of elongated horizontal grate elements when the grate is disposed atop the said elevated grate support flanges on said grate riser frame.

2. A grate riser for use with catch basins as set forth in claim 1 wherein said upper riser elements are attached to and depend from inner surfaces of said opposing grate riser frame sections and at least substantially engage inner surfaces of said flange carrying sections of said catch basin frame so as to maintain said grate riser frame in fixed position horizontally atop said catch basin.

3. A grate riser for use with catch basins as set forth in claim 1 wherein said elevated horizontal grate support flanges associated respectively with said two opposite grate riser frame sections have outer surfaces substantially in coplanar relationship with inner surfaces of the corresponding frame sections whereby to at least substantially engage inner surfaces of said flange carrying sections of said catch basin frame so as to maintain said grate riser frame in fixed position horizontally atop the catch basin frame.

4. A grate riser for use with catch basins as set forth in claim 1, wherein said two horizontally spaced apart upper riser elements comprise small substantially vertically depending members welded to inner surfaces of said opposing grate riser frame sections and having said elevated horizontal grate support flanges welded to lower horizontal surfaces thereon.

5. A grate riser for use with catch basins as set forth in claim 4, wherein said upper riser elements take a generally triangular shape when viewed laterally.

6. A grate riser for use with catch basins as set forth in claim 1, wherein said lower riser elements take the form of depending flanges formed integrally with said elevated horizontal grate support flanges and resting upon said grate support flanges on said catch basin frame.

7. A grate riser for use with catch basins as set forth in claim 6, wherein said depending flanges forming said lower riser elements are formed approximately intermediate the width of the elevated horizontal grate support flanges to provide therewith substantially a "T" configuration in cross section.

8. A grate riser for use with catch basins as set forth in claim 7, wherein the length of said elevated horizontal grate support flanges and associated depending riser flanges is such as to result in the engagement of end surfaces thereof with opposing frame sections of an associated catch basin and to thereby restrain the grate riser against horizontal movement relative to the catch basin frame.

* * * * *